US008053997B2

(12) United States Patent
Salvestrini

(10) Patent No.: US 8,053,997 B2
(45) Date of Patent: Nov. 8, 2011

(54) LOAD CONTROL DEVICE HAVING A TRIGGER CIRCUIT CHARACTERIZED BY A VARIABLE VOLTAGE THRESHOLD

(75) Inventor: Christopher James Salvestrini, Allentown, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 273 days.

(21) Appl. No.: 12/437,859

(22) Filed: May 8, 2009

(65) Prior Publication Data

US 2009/0219005 A1 Sep. 3, 2009

Related U.S. Application Data

(62) Division of application No. 11/705,477, filed on Feb. 12, 2007, now Pat. No. 7,570,031.

(60) Provisional application No. 60/783,538, filed on Mar. 17, 2006.

(51) Int. Cl.
*H05B 37/02* (2006.01)

(52) U.S. Cl. ..... 315/209 CD; 315/209 R; 315/291; 315/299; 315/260; 323/223; 323/231; 323/232

(58) Field of Classification Search ..... 315/307, 315/116, 129, 194, 294, 209 R, 224, 240, 315/241 R, 209 CD, 299, 360, 291; 323/325, 323/365, 265, 223, 231, 232
See application file for complete search history.

(56) References Cited

U.S. PATENT DOCUMENTS 3,746,951 A * 7/1973 Hohman ..... 318/786
4,008,416 A 2/1977 Nakasone
4,954,768 A 9/1990 Luchaco et al.
(Continued)

FOREIGN PATENT DOCUMENTS

DE 3913932 A1 11/1990
(Continued)

OTHER PUBLICATIONS

European Patent Office, International Preliminary Report on Patentability for International Patent Application No. PCT/US07/06474, Apr. 27, 2011, 6 pages.

(Continued)

*Primary Examiner* — Shawki Ismail
*Assistant Examiner* — Thienvu Tran
(74) *Attorney, Agent, or Firm* — Mark E. Rose; Philip N. Smith

(57) ABSTRACT

A two-wire load control device, such as a dimmer, is operable to control the amount of power delivered to an electrical load, such as a magnetic low-voltage (MLV) load, and comprises a bidirectional semiconductor switch, a timing circuit, a trigger circuit having a variable voltage threshold, and a clamp circuit. When a timing voltage signal of the timing circuit exceeds an initial magnitude of the variable voltage threshold, the trigger circuit is operable to render the semiconductor switch conductive, reduce the timing voltage signal to a predetermined magnitude less than the initial magnitude, and to increase the variable voltage threshold to a second magnitude greater than the first magnitude. The clamp circuit limits the magnitude of the timing voltage signal to a clamp magnitude between the initial magnitude and the second magnitude, thereby preventing the timing voltage signal from exceeding the second magnitude. Accordingly, multiple attempted firings of the semiconductor switch are avoided, and the MLV dimmer is prevented from conducting asymmetric current when an MLV transformer of the MLV load is unloaded.

13 Claims, 12 Drawing Sheets

U.S. PATENT DOCUMENTS

| | | | | |
|---|---|---|---|---|
| 5,477,111 | A | 12/1995 | Steely et al. | |
| 5,619,081 | A * | 4/1997 | Gershen et al. | 307/125 |
| 7,193,404 | B2 * | 3/2007 | Weightman | 323/325 |
| 7,482,758 | B2 * | 1/2009 | Hua et al. | 315/119 |
| 7,570,031 | B2 | 8/2009 | Salvestrini | |
| 2005/0168896 | A1 | 8/2005 | Vanderzon | |
| 2006/0109702 | A1 | 5/2006 | Weightman | |
| 2006/0255746 | A1 * | 11/2006 | Kumar et al. | 315/209 R |
| 2006/0255959 | A1 * | 11/2006 | Salvestrini | 340/664 |
| 2007/0236152 | A1 | 10/2007 | Davis et al. | |
| 2007/0285027 | A1 | 12/2007 | Gehman | |

FOREIGN PATENT DOCUMENTS

| | | | |
|---|---|---|---|
| WO | WO 03/081962 | A | 10/2003 |

OTHER PUBLICATIONS

European Patent Office, International Search Report and Written Opinion for International Patent Application No. PCT/US2007/006474, Aug. 30, 2007, 13 pages.

Abstract of DE 3913932 from espace.net.

* cited by examiner

LOAD CONTROL DEVICE HAVING A TRIGGER CIRCUIT CHARACTERIZED BY A VARIABLE VOLTAGE THRESHOLD

RELATED APPLICATIONS

This application is a divisional application of commonly-assigned U.S. patent application Ser. No. 11/705,477, filed Feb. 12, 2007, now U.S. Pat. No. 7,570,031, issued Aug. 4, 2009, entitled METHOD AND APPARATUS FOR PREVENTING MULTIPLE ATTEMPTED FIRINGS OF A SEMICONDUCTOR SWITCH IN A LOAD CONTROL DEVICE, which claims priority to U.S. Provisional Application Ser. No. 60/783,538, filed Mar. 17, 2006, entitled DIMMER FOR PREVENTING ASYMMETRIC CURRENT FLOW THROUGH AN UNLOADED MAGNETIC LOW VOLTAGE TRANSFORMER, the entire disclosures of which are hereby incorporated by reference.

BACKGROUND OF THE INVENTION

1. Field of the Invention

The present invention relates to load control devices for controlling the amount of power delivered to an electrical load. More specifically, the present invention relates to a drive circuit for a two-wire analog dimmer that includes a trigger circuit having a variable voltage threshold for preventing multiple attempted firings of a bidirectional semiconductor switch of the dimmer.

2. Description of the Related Art

A typical lighting dimmer is coupled between a source of alternating-current (AC) power (typically 50 or 60 Hz line voltage AC mains) and a lighting load. Standard dimmers use one or more semiconductor switches, such as triacs or field effect transistors (FETs), to control the amount of power delivered to the lighting load and thus the intensity of the light emitted by the load. The semiconductor switch is typically coupled in series between the source and the lighting load. Using a phase-control dimming technique, the dimmer renders the semiconductor switch conductive for a portion of each line half-cycle to provide power to the lighting load, and renders the semiconductor switch non-conductive for the other portion of the line half-cycle to disconnect power from the load.

Some dimmers are operable to control the intensity of low-voltage lighting loads, such as magnetic low-voltage (MLV) and electronic low-voltage (ELV) loads. Low-voltage loads are generally supplied with AC power via a step-down transformer, typically an isolation transformer. These step-down transformers step the voltage down to the low-voltage level, for example 12 to 24 volts, necessary to power the lamp or lamps. One problem with low-voltage lighting loads employing a transformer, specifically MLV loads, is that the transformers are susceptible to any direct-current (DC) components of the voltage provided across the transformer. A DC component in the voltage across the transformer can cause the transformer to generate acoustic noise and to saturate, increasing the temperature of the transformer and potentially damaging the transformer.

FIG. 1A is a simplified schematic diagram of a prior art magnetic low-voltage dimmer 10. The prior art dimmer 10 is coupled to an AC power source 12 via a HOT terminal 14 and an MLV load 16 via a DIMMED HOT terminal 18. The MLV load 16 includes a transformer 16A and a lamp load 16B. The dimmer 10 further comprises a triac 20, which is coupled in series electrical connection between the source 12 and the MLV load 16 and is operable to control the power delivered to the MLV load. The triac 20 has a gate (or control input) for rendering the triac conductive. Specifically, the triac 20 becomes conductive at a specific time each half-cycle and becomes non-conductive when a load current $i_L$ through the triac becomes substantially zero amps, i.e., at the end of the half-cycle. The amount of power delivered to the MLV load 16 is dependent upon the portion of each half-cycle that the triac 20 is conductive. An inductor L22 is coupled in series with the triac 20 for providing noise filtering of electromagnetic interference (EMI) at the HOT terminal 14 and DIMMED HOT terminal 18 of the dimmer 10.

A timing circuit 30 includes a resistor-capacitor (RC) circuit coupled in parallel electrical connection with the triac 20. Specifically, the timing circuit 30 comprises a potentiometer R32 and a capacitor C34. As the capacitor C34 charges and discharges each half-cycle of the AC power source 12, a voltage $v_C$ develops across the capacitor. A plot of the voltage $v_C$ across the capacitor C34 and the load current $i_L$ through the MLV load 16 is shown in FIG. 2. The capacitor C34 begins to charge at the beginning of each half-cycle (i.e., at time to in FIG. 2) at a rate dependent upon the resistance of the potentiometer R32 and the capacitance of the capacitor C34.

A diac 40, which is employed as a trigger device, is coupled in series between the timing circuit 30 and the gate of the triac 20. As soon as the voltage $v_C$ across the capacitor C34 exceeds a break-over voltage $V_{BR}$ (e.g., 30V) of the diac 40, the voltage across the diac quickly decreases in magnitude to a break-back voltage $V_{BB}$. The quick change in voltage across the diac 40 and the capacitor C34 causes the diac to conduct a gate current $i_{GATE}$ to and from the gate of the triac 20. The gate current $i_{GATE}$ flows into the gate of the triac 20 during the positive half-cycles and out of the gate of the triac during the negative half-cycles.

FIG. 1B is a plot of the voltage-current characteristic of a typical diac. The values of the break-over voltage $V_{BR}$ and the break-back voltage $V_{BB}$ may differ slightly during the positive half-cycles and the negative half-cycles. Thus, the voltage-current characteristic of FIG. 1B shows the positive break-over voltage $V_{BR+}$ and the positive break-back voltage $V_{BB+}$ occurring during the positive half-cycles and the negative break-over voltage $V_{BR-}$ and the negative break-back voltage $V_{BB-}$ occurring during the negative half-cycles.

The charging time of the capacitor C34, i.e., the time constant of the RC circuit, varies in response to changes in the resistance of potentiometer R32 to alter the times at which the triac 20 begins conducting each half-cycle of the AC power source 12. The magnitude of the gate current $i_{GATE}$ is limited by a gate resistor R42. The gate current $i_{GATE}$ flows for a period of time $T_{PULSE}$, which is determined by the capacitance of the capacitor C34, the difference between the break-over voltage $V_{BR}$ and the break-back voltage $V_{BB}$ of the diac 40, and the magnitude of the gate current $i_{GATE}$. After the voltage $v_C$ across the capacitor C34 has exceeded the break-over voltage $V_{BR}$ of the diac 40 and the gate current $i_{GATE}$ has decreased to approximately zero amps, the voltage $v_C$ decreases by substantially the break-back voltage $V_{BB}$ of the diac 40.

While the gate current $i_{GATE}$ is flowing through the gate of the triac 20, the triac will begin to conduct current through the main load terminals, i.e., between the source 12 and the MLV load 16 (as shown at time $t_1$ in FIG. 2). In order for the triac 20 to remain conductive after the gate current $i_{GATE}$ ceases to flow, the load current $i_L$ must exceed a predetermined latching current $I_{LATCH}$ of the triac before the gate current reaches zero amps. When the MLV lamp 16B is connected to the MLV transformer 16A, the load current $i_L$ through the main load terminals of the triac 20 is large enough such that the load current exceeds the latching current $I_{LATCH}$ of the triac. Thus, when the magnitude of the gate current $i_{GATE}$ falls to substantially zero amps after the gate current period $T_{PULSE}$, the triac 20 remains conductive during the rest of the present half-cycle, i.e., until the load current $i_L$ through the main load terminals of the triac 20 nears zero amps (e.g., at time $t_2$ in FIG. 2).

When the MLV lamp 16B is not connected to the MLV transformer 16A, i.e., the MLV transformer is unloaded, the MLV load 16 will have a larger inductance than when the MLV lamp is connected to the MLV transformer. The larger inductance L causes the load current $i_L$ through the main load terminals of the triac 20 to increase at a slower rate since the rate of change of the current through an inductor is inversely proportional to the inductance, i.e., $di_L/dt=v_L/L$ (assuming the instantaneous voltage $v_L$ across the inductor remains constant). Accordingly, when the MLV lamp 16B is not connected, the load current $i_L$ may not rise fast enough to exceed the latching current of the triac 20, and the triac may stop conducting when the gate current $i_{GATE}$ falls to substantially zero amps.

FIG. 3 is a plot of the voltage $v_C$ across the capacitor C34 and the load current $i_L$ when the MLV transformer 16A is unloaded. After the voltage $v_C$ exceeds the break-over voltage $V_{BR}$ of the diac 40 (as shown by a peak $A_1$), the load current $i_L$ begins to increase slowly (as shown by a peak $B_1$). However, the load current $i_L$ does not reach the latching current $I_{LATCH}$ of the triac 20 before the gate current $I_{GATE}$ stops flowing, and thus the triac 10 does not latch on and the load current $i_L$ will begin to decrease. Because the triac 20 did not latch and becomes non-conductive, the voltage across the timing circuit 20 will be a substantially large voltage, i.e., substantially equal to the voltage of the AC power source 12, and the capacitor C34 will begin to charge again (as shown by a peak $A_2$). Note that the load current $i_L$ does not have enough time to drop to zero amps. When the voltage $v_C$ exceeds the break-over voltage $V_{BR}$ for the second time in the present half-cycle, the gate current $i_{GATE}$ flows through the gate and the triac 20 will once again attempt to fire (as shown by a peak $B_2$). Because the load current $i_L$ is not zero amps when the gate current $i_{GATE}$ begins to flow, the load current rises to a greater value than was achieved at peak $B_1$. Nonetheless, the load current $i_L$ does not reach the latching current $I_{LATCH}$, and thus the cycle repeats again (as shown by peaks $A_3$ and $B_3$). A similar, but complementary, situation occurs during the negative half-cycles. As shown in FIG. 3, the load current $i_L$ does not exceed the latching current $I_{LATCH}$ during any of the AC line half-cycles.

As the situation of FIG. 3 repeats for multiple half-cycles, i.e., the triac 20 attempts to repeatedly fire from one half-cycle to the next, the load current $i_L$ through the main load terminals of the triac may acquire either a positive or a negative DC component. Eventually, the DC component will cause the load current $i_L$ to exceed the latching current $I_{LATCH}$ during some half-cycles, e.g., the negative half-cycles as shown in FIG. 4. Thus, an asymmetric load current $i_L$ will flow through the MLV load 16, causing the MLV transformer 16A to generate acoustic noise and to overheat, which can potentially damage the MLV transformer.

Thus, there exists a need for an MLV dimmer that prevents the conduction of asymmetric currents through an MLV load when the MLV transformer is unloaded.

SUMMARY OF THE INVENTION

According to an embodiment of the present invention, a trigger circuit operable to control a semiconductor switch in a load control device is characterized by a variable voltage threshold. The trigger circuit comprises a break-over circuit and an offset circuit. The break-over circuit is characterized by a break-over voltage and is operable to conduct a control current when a voltage across the break-over circuit exceeds the break-over voltage. The semiconductor switch is operable to change between the non-conductive and conductive states in response to the control current. The offset circuit is coupled in series with the break-over circuit and comprises an offset capacitor operable to conduct the control current, whereby an offset voltage develops across the offset capacitor. The trigger circuit is characterized by an initial voltage threshold before the break-over circuit and the offset circuit conduct the control current. The initial voltage threshold has a magnitude substantially equal to the magnitude of the break-over voltage. The trigger circuit is further characterized by a second voltage threshold after the break-over circuit and the offset circuit conduct the control current. The second voltage threshold has a maximum magnitude substantially equal to the break-over voltage of the break-over circuit plus the offset voltage.

The present invention further provides a drive circuit for controlling a semiconductor switch in a load control device. The drive circuit comprises a break-over circuit characterized by a break-over voltage and operable to conduct a control current when a voltage across the break-over circuit exceeds the break-over voltage, and an offset circuit coupled in series with the break-over circuit and comprising on offset capacitor operable to conduct the control current, whereby an offset voltage develops across the offset capacitor. The semiconductor switch is operable to change between the non-conductive and conductive states in response to the control current. The drive circuit further comprises a clamp circuit operable to limit the magnitude of the voltage across the series combination of the break-over circuit and the offset circuit to approximately a clamp magnitude that is greater than the initial voltage threshold and less than the second voltage threshold. The break-over circuit is operable to conduct the control current when a voltage across the series combination of the break-over circuit and the offset circuit exceeds a initial voltage threshold and to conduct the control current again only if the voltage across the series combination of the break-over circuit and the offset circuit subsequently exceeds a second voltage threshold. The initial voltage threshold has a magnitude approximately equal to the magnitude of the break-over voltage of the break-over circuit, and the second voltage threshold has a magnitude approximately equal to the break-over voltage of the break-over circuit plus the offset voltage. In addition, the drive circuit may also comprise a clamp circuit operable to limit the magnitude of the voltage across the series combination of the break-over circuit and the offset circuit to approximately a clamp magnitude greater than the initial voltage threshold and less than the second voltage threshold, such that the voltage across the series combination of the break-over circuit and the offset circuit is prevented from exceeding the second voltage threshold. The clamp circuit prevents the voltage across the series combination of the break-over circuit and the offset circuit from exceeding the second voltage threshold.

Other features and advantages of the present invention will become apparent from the following description of the invention that refers to the accompanying drawings.

DETAILED DESCRIPTION OF THE INVENTION

Figure 1A:
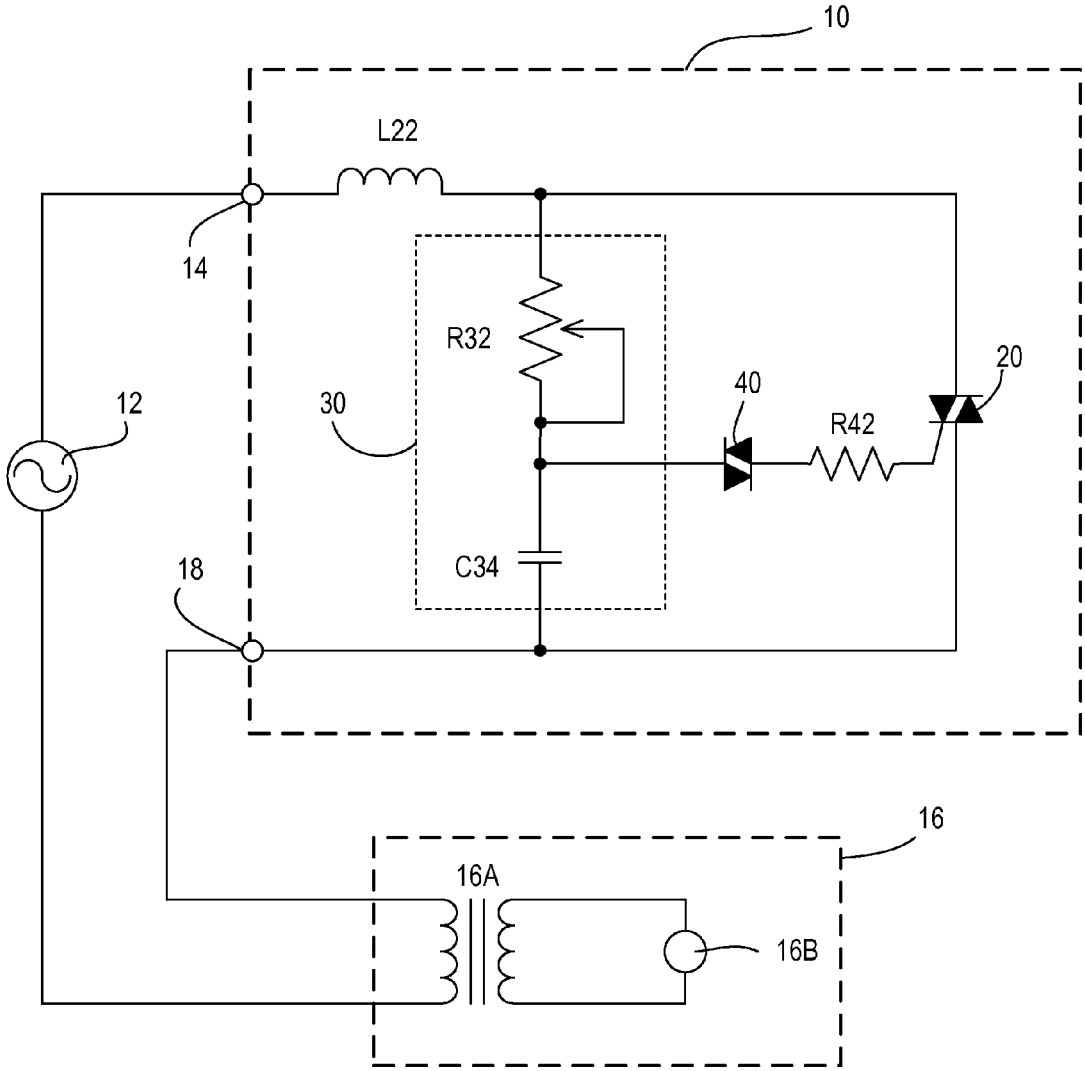
Fig. 1A Prior Art
FIG. 1A is a simplified schematic diagram of a prior art MLV dimmer.
Figure 1B:
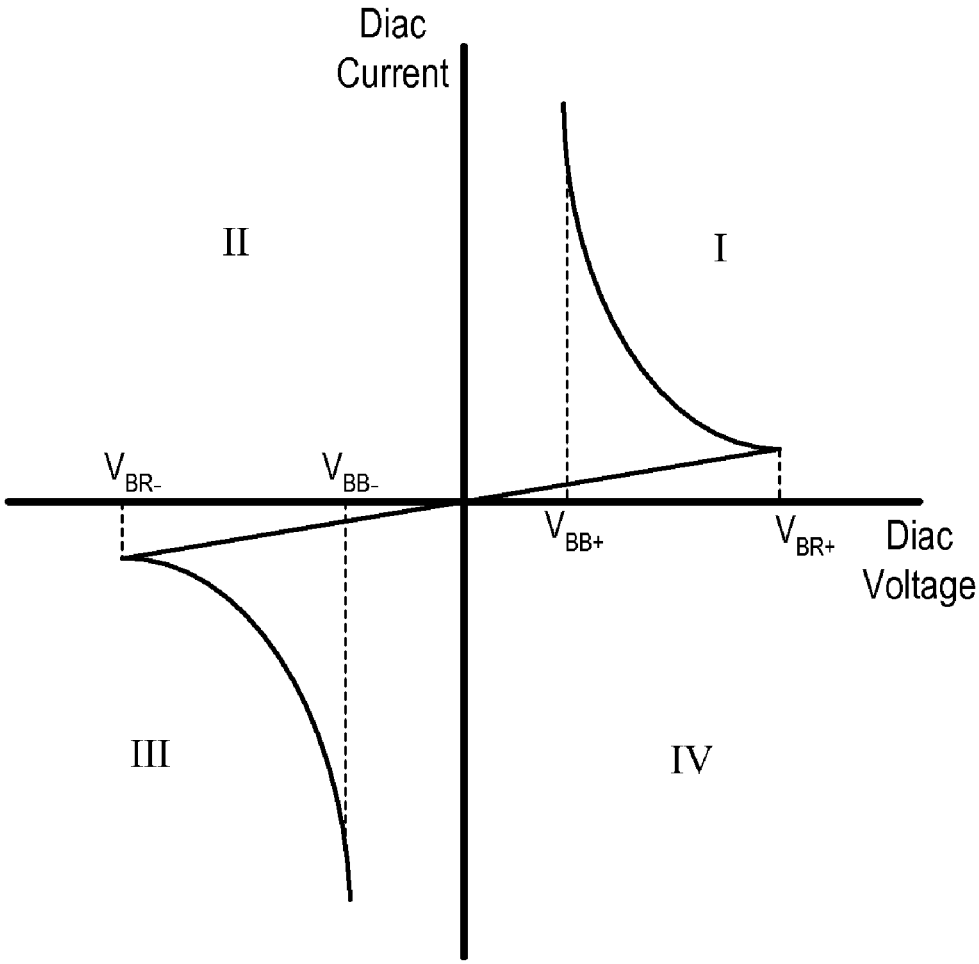
Fig. 1B Prior Art
FIG. 1B is a plot of a voltage-current characteristic of a diac of the MLV dimmer of FIG. 1A.
Figure 2:
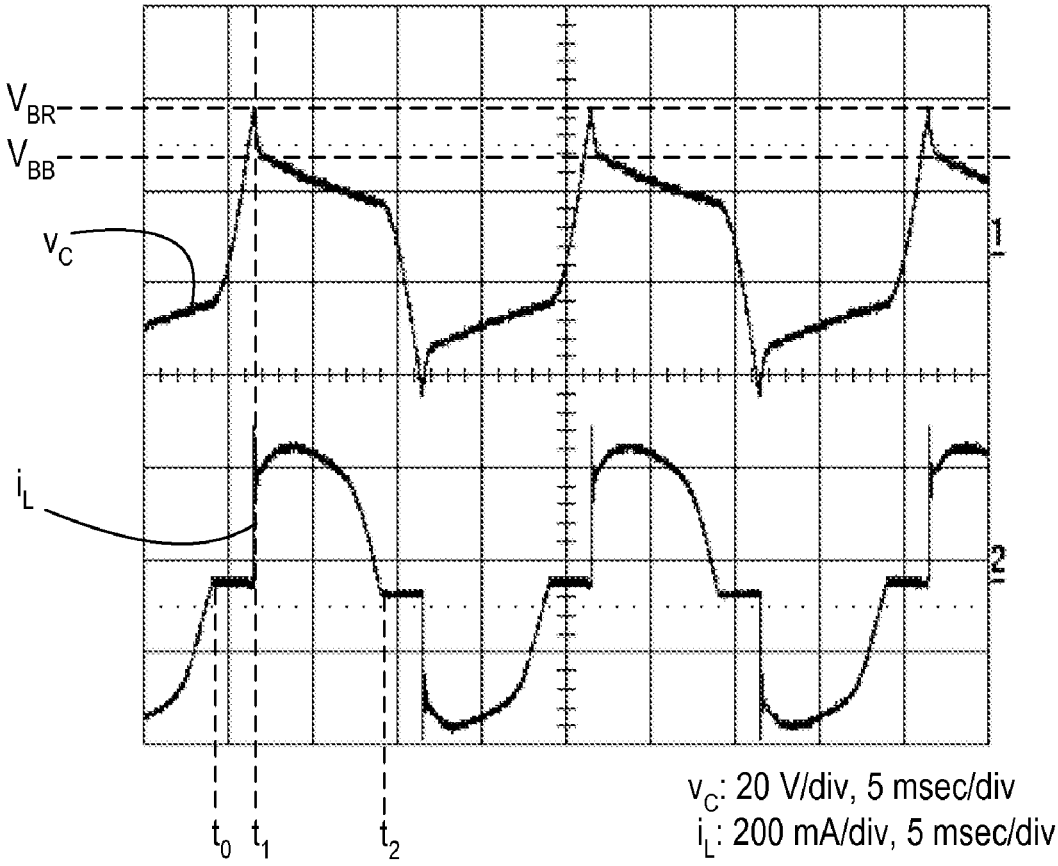
Fig. 2 Prior Art
FIG. 2 is a plot of a voltage across a timing capacitor in and a load current $i_L$ through the MLV dimmer of FIG. 1A.
Figure 3:
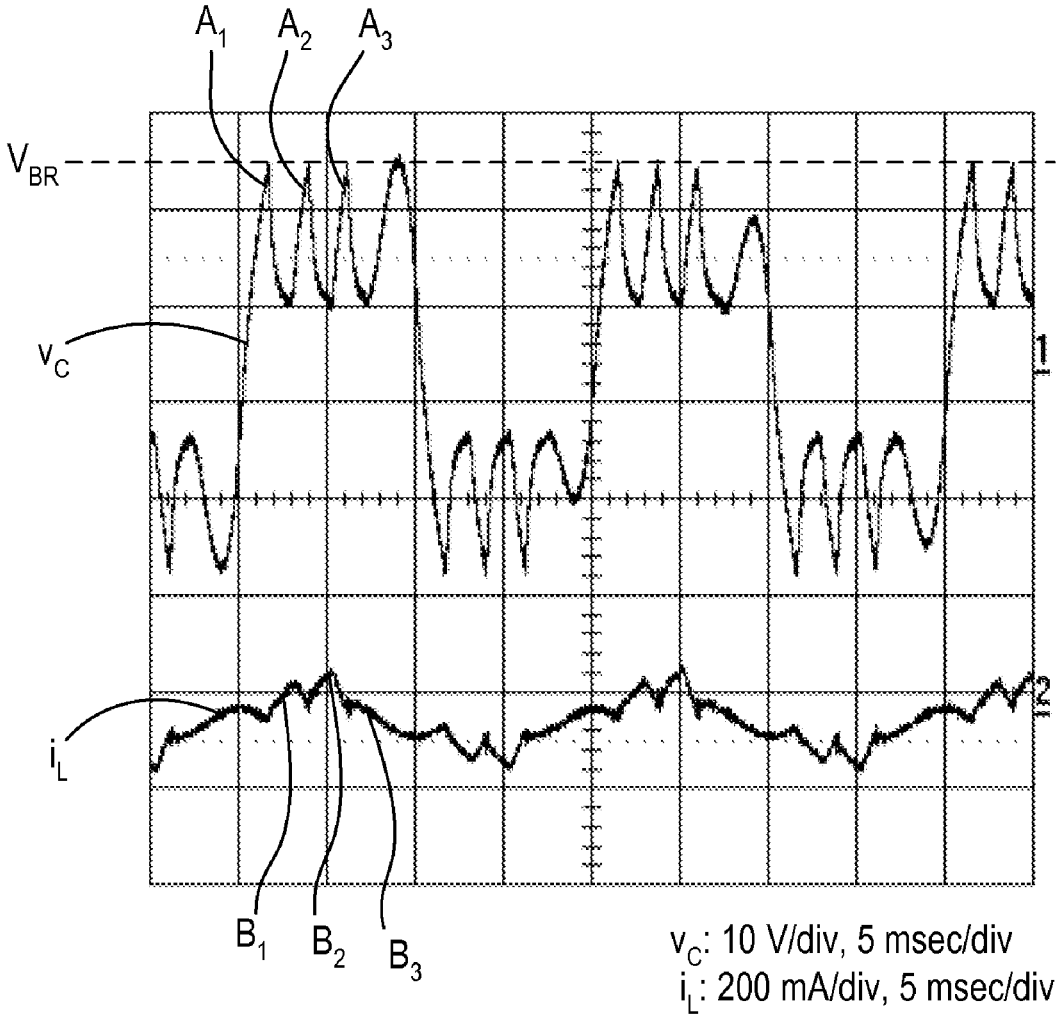
Fig. 3 Prior Art
FIG. 3 is a plot of the voltage across the timing capacitor and the load current $i_L$ when the MLV transformer is unloaded.
Figure 4:
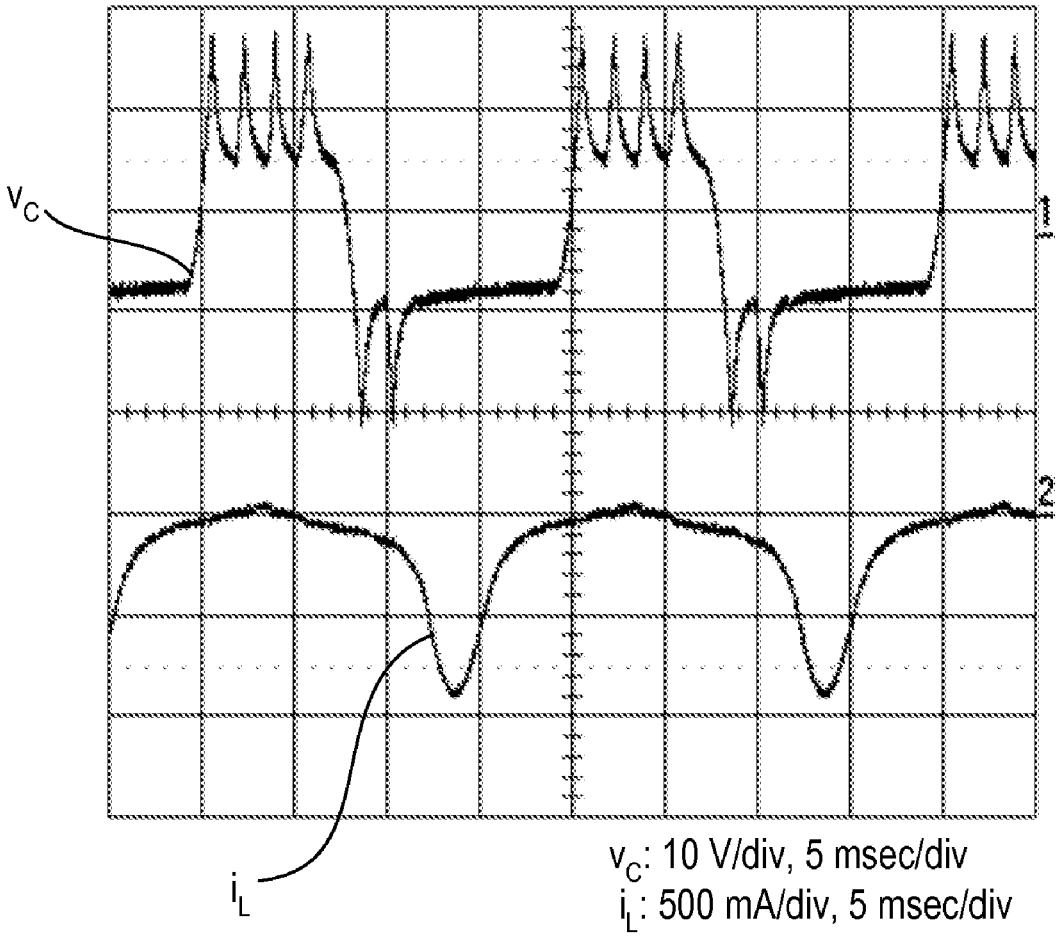
Fig. 4 Prior Art
FIG. 4 is a plot of the voltage across the timing capacitor and the load current $i_L$ demonstrating asymmetric behavior when the MLV transformer is unloaded.

The foregoing summary, as well as the following detailed description of the preferred embodiments, is better understood when read in conjunction with the appended drawings. For the purpose of illustrating the invention, there is shown in the drawings an embodiment that is presently preferred, in which like numerals represent similar parts throughout the several views of the drawings, it being understood, however, that the invention is not limited to the specific methods and instrumentalities disclosed.

Figure 5A:
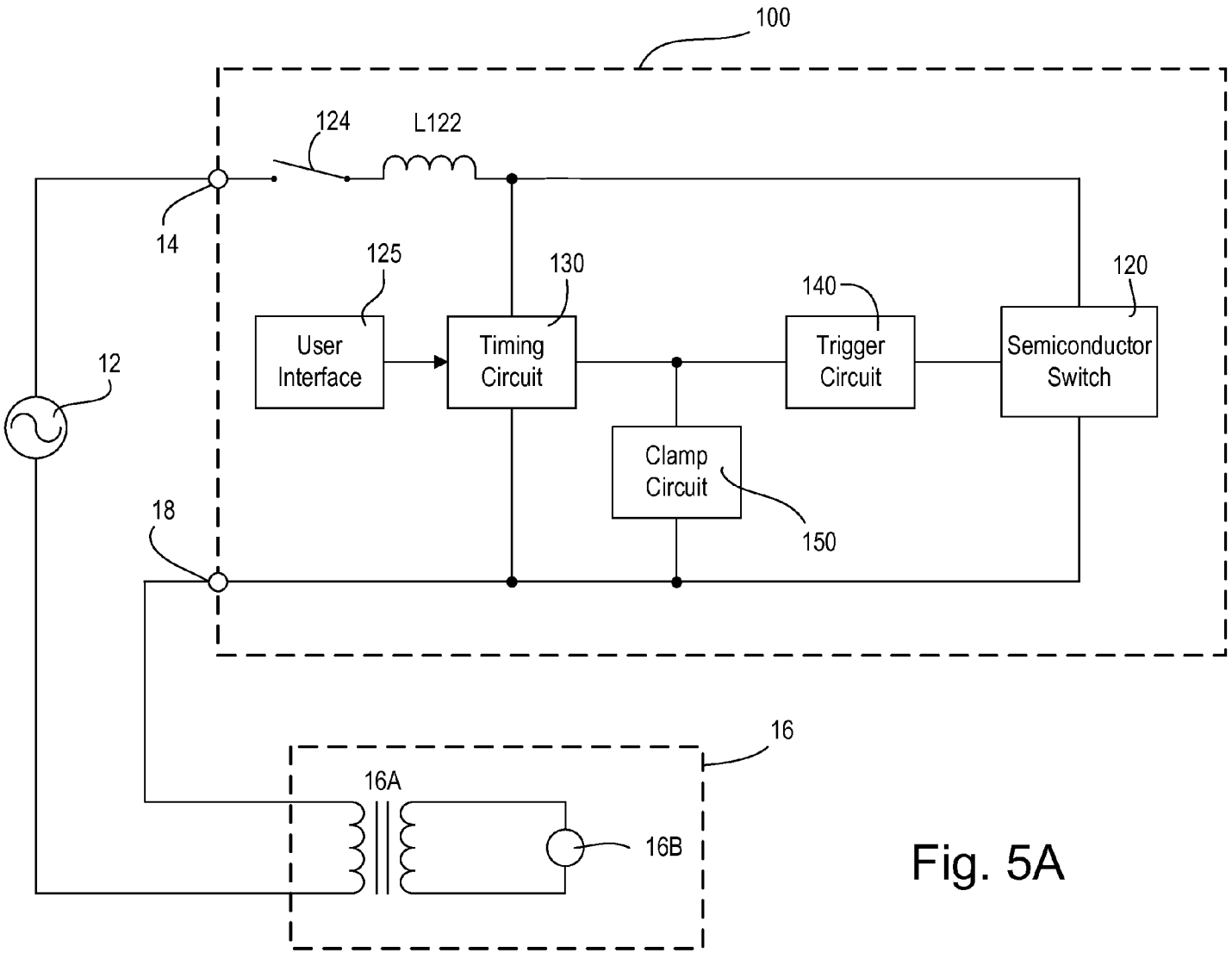
FIG. 5A is a simplified block diagram of an MLV dimmer according to the present invention.

FIG. 5A is a simplified block diagram of an MLV dimmer 100 according to the present invention. The MLV dimmer 100 comprises a semiconductor switch 120 coupled in series electrical connection between the AC power source 12 and the MLV load 16. The semiconductor switch 120 may comprise a triac, a field effect transistor (FET) or an insulated gate bipolar transistor (IGBT) in a full-wave rectifier bridge, two FETs or two IGBTs in anti-series connection, or any other suitable type of bidirectional semiconductor switch. The semiconductor switch 120 has a control input for controlling the semiconductor switch between a substantially conductive state and a substantially non-conductive state.

A timing circuit 130 is coupled in parallel electrical connection with the semiconductor switch 120 and provides a timing voltage signal $v_T$ at an output. The timing voltage signal $v_T$ increases with respect to time at a rate dependent on a target dimming level of the MLV load 16. A user interface 125 provides an input to the timing circuit 130 to provide the target dimming level of the MLV load 16 and to control the rate at which the timing voltage signal $v_T$ increases. A trigger circuit 140 is coupled between the output of the timing circuit 130 and the control input of the semiconductor switch 120. As the timing voltage signal $v_T$ increases, a trigger voltage signal develops across the trigger circuit 140. The trigger voltage signal typically has a magnitude that is substantially equal to the magnitude of the timing voltage signal $v_T$.

The trigger circuit 140 is characterized by a variable voltage threshold $V_{TH}$, which has an initial value of $V_1$. When the timing voltage signal $v_T$ at the output of the timing circuit 130 exceeds substantially the initial value $V_1$ of the voltage threshold $V_{TH}$, the trigger circuit 130 conducts a control current $i_{CONTROL}$, which causes the semiconductor switch 120 to become conductive. At this time, the timing voltage signal $v_T$ is reduced to a level less than the initial voltage threshold $V_1$ and the voltage threshold $V_{TH}$ is preferably increased by an increment $\Delta V$. Accordingly, the timing voltage signal $v_T$ will need to rise to a greater level to exceed the new incremented voltage threshold, i.e., $V_{TH}=V_1+\Delta V$. Preferably, the voltage threshold $V_{TH}$ is reset to the initial voltage threshold $V_1$ after a predetermined period of time after being increased to $V_1+\Delta V$. Preferably, the voltage threshold $V_{TH}$ is reset to the initial voltage threshold $V_1$ prior to the start of the next line voltage cycle.

The MLV dimmer 100 further comprises a clamp circuit 150 coupled between the output of the timing circuit 130 and the DIMMED HOT terminal 18. The clamp circuit 150 limits the magnitude of the timing voltage signal $v_T$ at the output of the timing circuit 130 to approximately a clamp voltage $V_{CLAMP}$. Accordingly, the magnitude of the trigger voltage across the trigger circuit 140 is also limited. The clamp voltage $V_{CLAMP}$ preferably has a magnitude greater than the initial voltage threshold $V_1$, but less than the incremented voltage threshold, i.e., $$V_1<V_{CLAMP}<V_1+\Delta V.$$

The MLV dimmer 100 also comprises a mechanical switch 124 coupled in series with the semiconductor switch 120, i.e., in series between the AC power source 12 and the MLV load 16. When the mechanical switch 124 is open, the AC power source 12 is disconnected from the MLV load 16, and thus the MLV lamp 16B is off. When the mechanical switch 124 is closed, the semiconductor switch 120 is operable to control the intensity of the MLV lamp 16B. An inductor L122 is coupled in series with the semiconductor switch 120 to providing filtering of EMI noise.

Figure 5B:
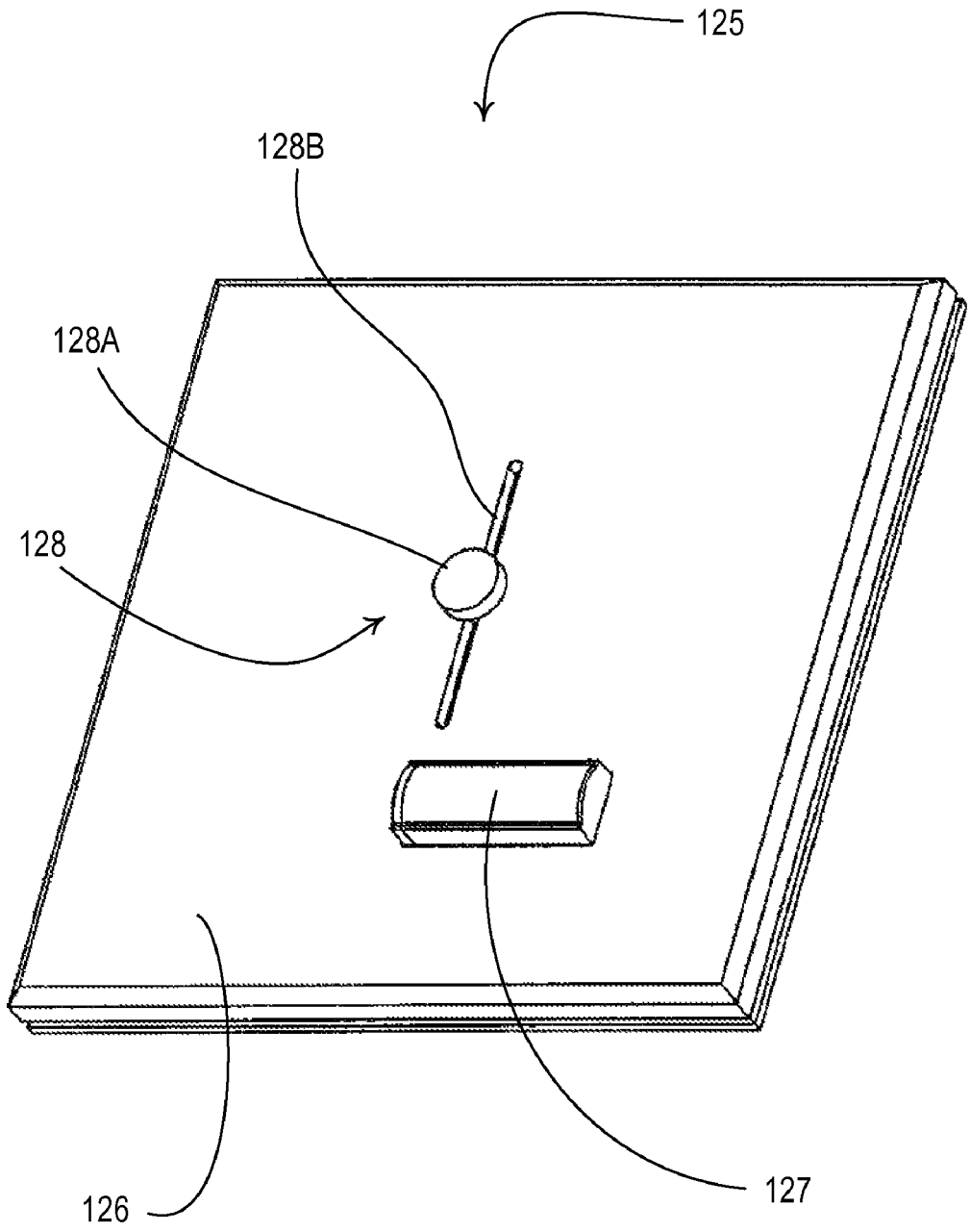
FIG. 5B is a perspective view of a user interface of the MLV dimmer of FIG. 5A.

FIG. 5B is a perspective view of the user interface 125 of the MLV dimmer 100. The user interface 125 includes a faceplate 126, a pushbutton 127 (i.e., a toggle actuator), and a slider control 128. Pressing the pushbutton 127 actuates the mechanical switch 124 inside the dimmer 100. Consecutive presses of the pushbutton 127 toggle the mechanical switch 124 between an open state and a closed state. The slider control 128 comprises an actuator knob 128A mounted for sliding movement along an elongated slot 128B. Moving the actuator knob 128A to the top of the elongated slot 128B increases the intensity of the MLV lamp 16B and moving the actuator knob 128A to the bottom of the elongated slot 128B decreases the intensity of the MLV lamp.

Figure 6:
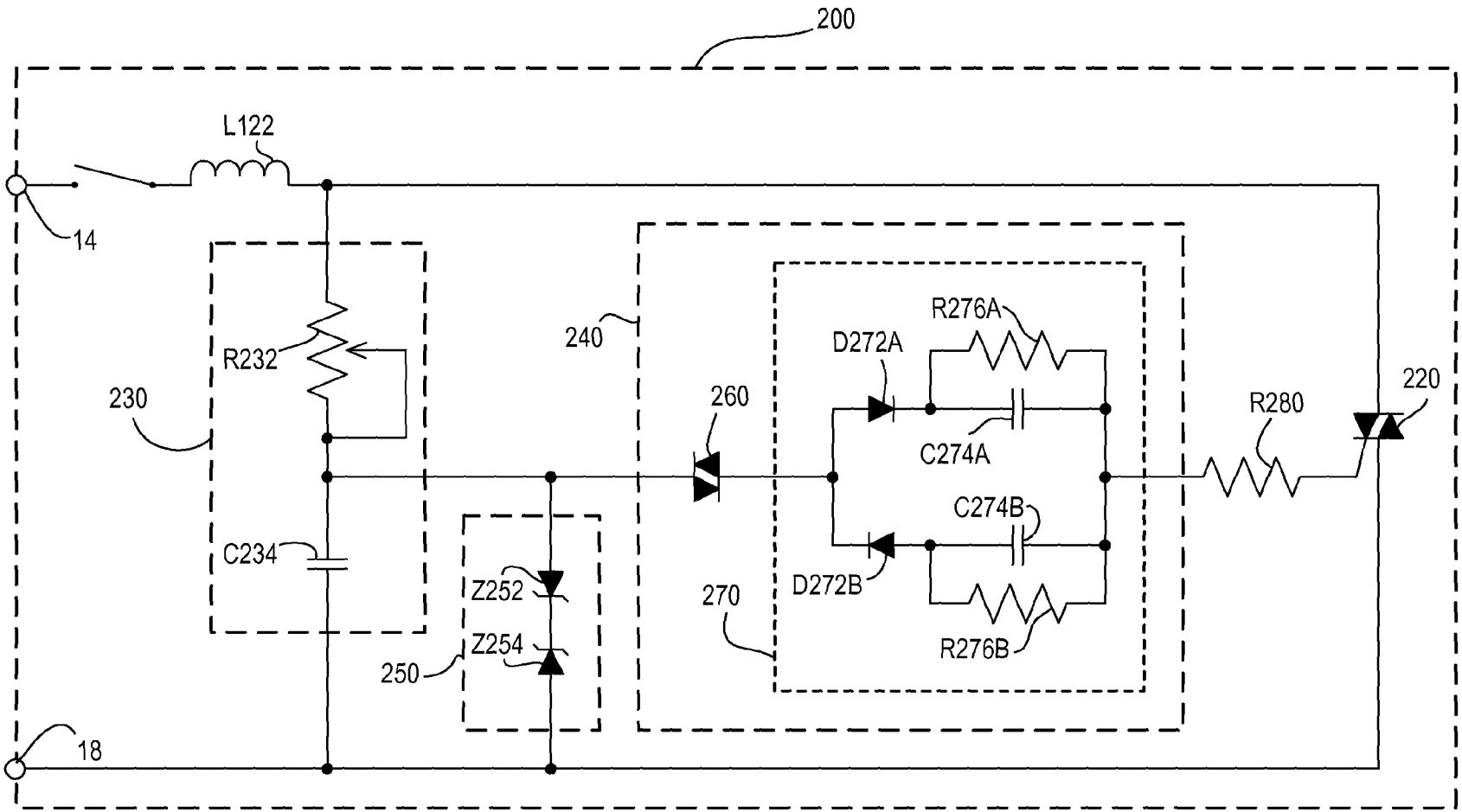
FIG. 6 is a simplified schematic diagram of an MLV dimmer according to a first embodiment of the present invention.

FIG. 6 is a simplified schematic diagram of an MLV dimmer 200 according to a first embodiment of the present invention. The MLV dimmer 200 comprises a triac 220 having a pair of main terminals coupled in series electrical connection between the AC power source 12 and the MLV load 16. The triac 220 has a control input, i.e., a gate terminal, for rendering the triac 220 conductive. The MLV dimmer 200 further comprises a timing circuit 230 coupled in parallel with the main terminals of the triac 220 and comprising a potentiometer R232 in series with a capacitor C234. A timing voltage signal $v_T$ is generated at an output, i.e., the junction of the potentiometer R232 and the capacitor C234, and is provided to a trigger circuit 240. The resistance of the potentiometer R232 may be varied in response to the actuation of a slider control of a user interface of the dimmer 200 (for example, the slider control 128 of the user interface 125).

The trigger circuit 240 is coupled in series electrical connection between the output of the timing circuit 230 and the gate of the triac 220. The trigger circuit 240 includes a break-over circuit comprising a diac 260, which operates similarly to the diac 40 in the prior art dimmer 10, and an offset circuit 270. As the timing voltage signal $v_T$ increases, a trigger voltage signal develops across the trigger circuit 240. Since the voltage across the gate-anode junction of the triac 220 (i.e., from the gate of the triac to the DIMMED HOT terminal 18) is a substantially small voltage, i.e., approximately 1 V, the magnitude of the trigger voltage signal is substantially equal to the magnitude of the timing voltage signal $v_T$.

When the timing voltage signal $v_T$ exceeds the break-over voltage $V_{BR}$ of the diac 260 (e.g., approximately 30V), a gate current $i_{GATE}$ flows through the offset circuit 270, specifically, through a diode D272A and a capacitor C274A into the gate of the triac 220 in the positive line voltage half-cycles, and out of the gate of the triac 220 and through a capacitor C274B and a diode D272B in the negative line voltage half-cycles. The capacitors C274A, C274B both have, for example, a capacitance of about 82 nF. The gate current $i_{GATE}$ flows for a period of time $T_{PULSE}$, e.g., approximately 1 μsec or greater. Discharge resistors R276A, R276B are coupled in parallel with the capacitors C274A, C274B, respectively. The MLV dimmer 200 further comprises a current limiting resistor R280 in series with the gate of the triac 220 to limit the magnitude of the gate current $i_{GATE}$, for example, to approximately 1 amp or less.

The MLV dimmer 200 also includes a clamp circuit 250 coupled between the output of the timing circuit 230 and the DIMMED HOT terminal 18. The clamp circuit 250 comprises two zener diodes Z252A, Z252B, each having the substantially the same break-over voltage $V_Z$, e.g., approximately 40V. The cathodes of the zener diodes Z252A, Z252B are coupled together such that the clamp circuit 250 limits the timing voltage signal $v_T$ to the same voltage, i.e., the break-over voltage $V_Z$, in both line voltage half-cycles.

Figure 7:
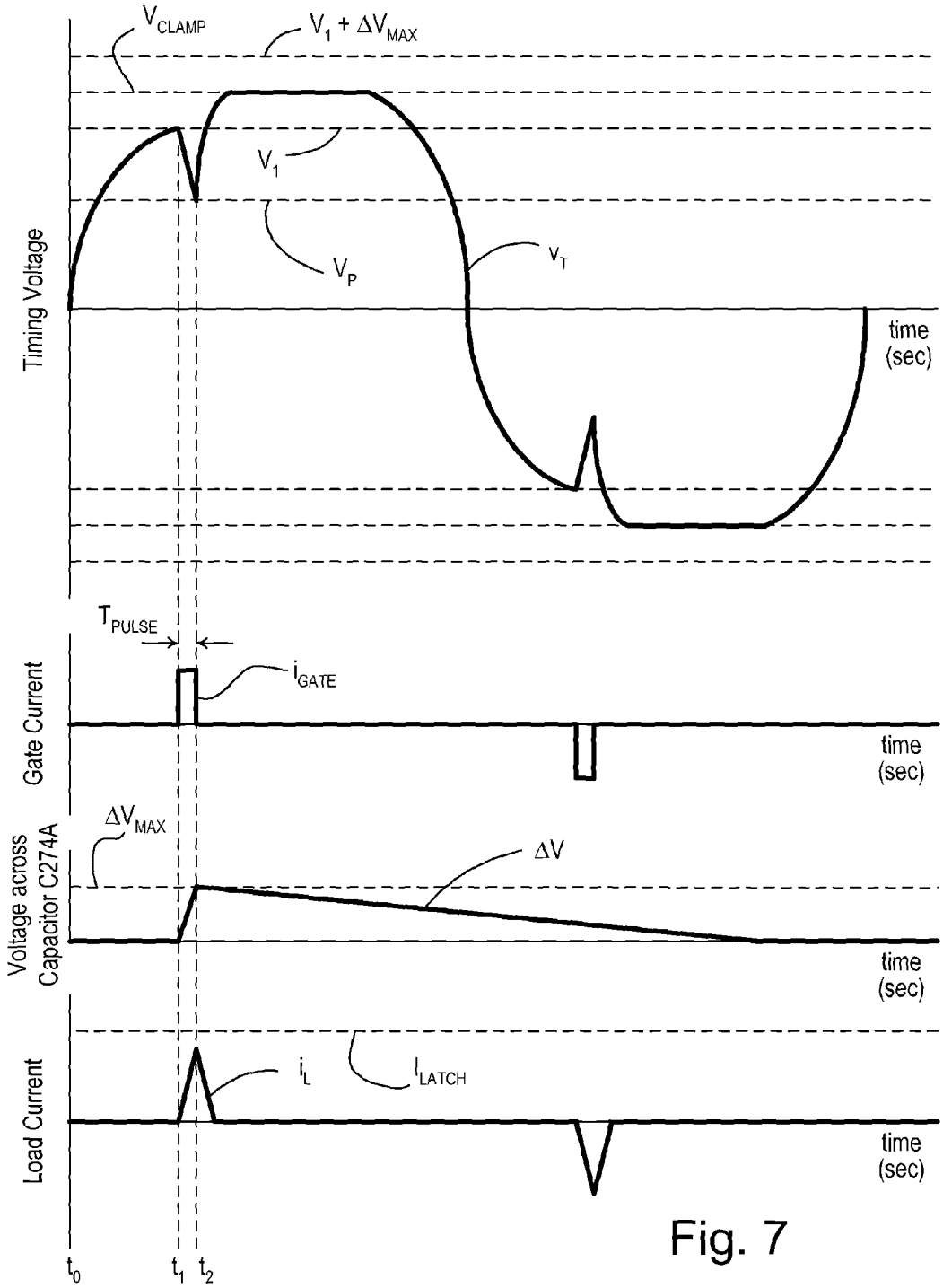
FIG. 7 is a diagram of waveforms demonstrating the operation of the MLV dimmer of FIG. 6.

FIG. 7 shows waveforms demonstrating the operation of the MLV dimmer 200. At the beginning of a positive half-cycle (e.g., at time to), the voltage threshold $V_{TH}$ of the trigger circuit 240 is at the initial voltage threshold $V_1$. At first, the capacitor C274A of the offset circuit 270 has no charge, and thus, no voltage is developed across the capacitor. The timing voltage signal $v_T$ increases until the initial voltage threshold $V_1$, i.e., the break-over voltage $V_{BR}$ of the diac 260 (plus the small forward drop of the diode D272A), is exceeded (at time $t_1$). At this time, the diac 260 conducts the gate current $i_{GATE}$ through the diode D272A and the capacitor C274A into the gate of the triac 220. A voltage ΔV develops across the offset circuit 270, specifically, across the capacitor C274A, and has a maximum magnitude $\Delta V_{MAX}$ equal to $$\Delta V_{MAX}=I_{GATE}\cdot T_{PULSE}/C_{274A},$$

where $C_{274A}$ is the capacitance of the capacitor C274A. In a preferred embodiment, the maximum magnitude voltage offset $\Delta V_{MAX}$ of the voltage developed across the capacitor C274A is approximately 12 volts.

After the diac 260 conducts the gate current $i_{GATE}$, the voltage across the capacitor C234 decreases by approximately the break-back voltage $V_{BB}$ of the diac to a predetermined voltage $V_P$. If the load current $i_L$ through the triac 220 does not reach the latching current $I_{LATCH}$ before the gate current $i_{GATE}$ stops flowing (at time $t_2$), the timing voltage signal $v_T$ will begin to increase again. Since the voltage threshold $V_{TH}$ is increased to the initial voltage threshold plus the offset voltage ΔV across the capacitor C274A, in order to conduct the gate current $i_{GATE}$ through the gate of the triac 220, the timing voltage signal $v_T$ must exceed $V_1+\Delta V$, i.e., approximately 42 volts. However, because the zener diode Z252A limits the timing voltage signal $v_T$ to the break-over voltage $V_Z$, i.e., 38 volts, the timing voltage $v_T$ is prevented from exceeding the voltage threshold $V_{TH}$. Accordingly, the triac 220 is prevented from repeatedly attempting to fire during each half-cycle and the load current $i_L$ is substantially symmetric, even when the MLV transformer 16A is unloaded.

The timing voltage signal $v_T$ is prevented from exceeding the voltage threshold $V_{TH}$ until the voltage ΔV across the capacitor C274A decays to approximately the break-over voltage $V_Z$ of the zener diode Z252A minus the break-over voltage $V_{BR}$ of the diac 242. The discharge resistor R276A preferably has a resistance of 68.1 kΩ, such that the capacitor C274A will discharge slowly, i.e., with a time constant of about 5.58 msec. Preferably, the time required for the voltage ΔV across the capacitor C274A to decay to approximately the break-over voltage $V_Z$ of the zener diode Z252A minus the break-over voltage $V_{BR}$ of the diac 242 is long enough such that the triac 220 only attempts to fire once during each half-cycle. As shown in FIG. 7, the voltage across the capacitor C274A decays to substantially zero volts during the negative half-cycle such that the voltage across the capacitor C274A is substantially zero volts at the beginning of the next positive half-cycle.

Figure 8:
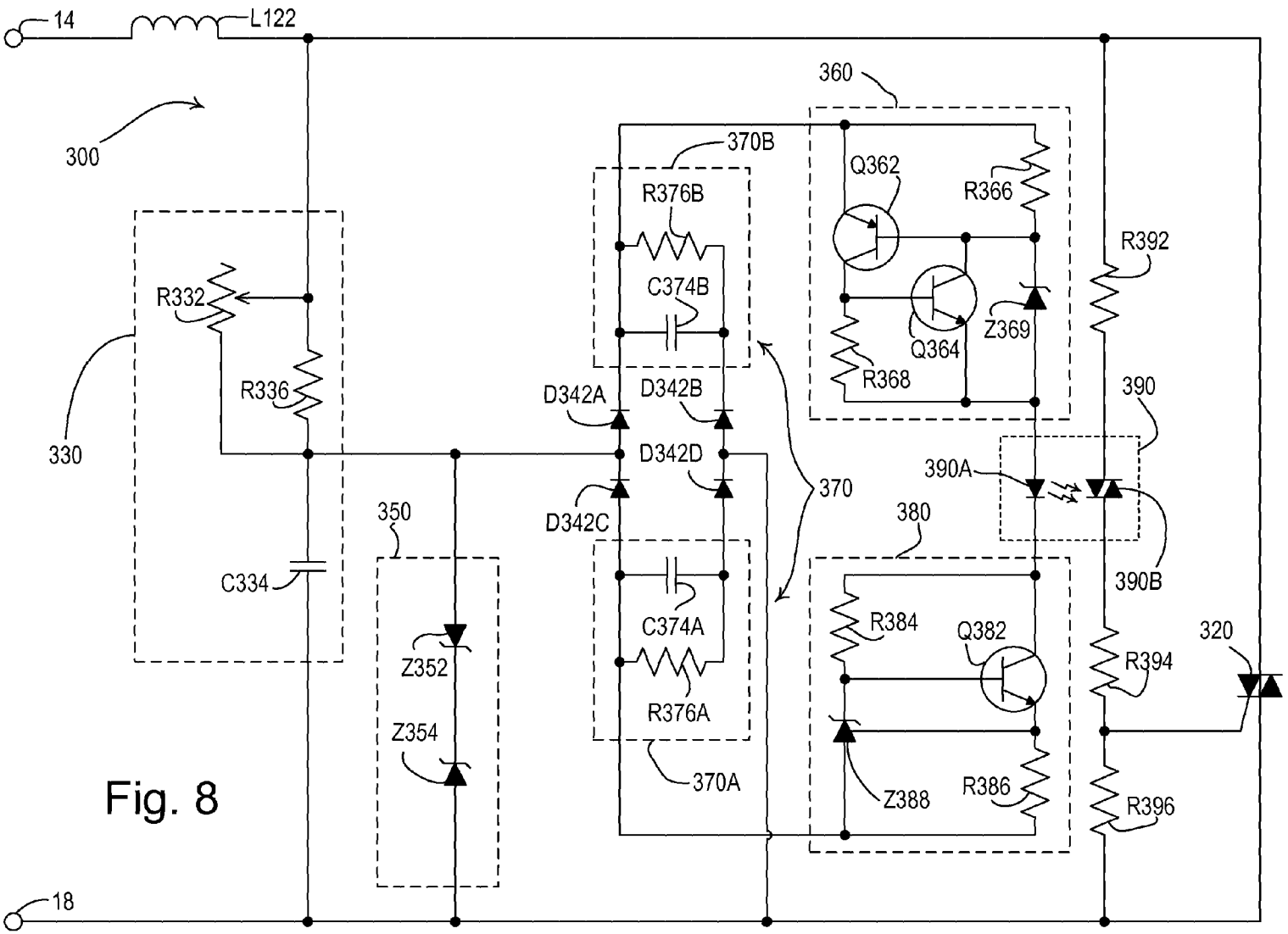
FIG. 8 is a simplified schematic diagram of an MLV dimmer according to a second embodiment of the present invention.

FIG. 8 is a simplified schematic diagram of an MLV dimmer 300 according to a second embodiment of the present invention. The MLV dimmer 300 includes a triac 320 in series electrical connection between the HOT terminal 14 and DIMMED HOT terminal 18 and a timing circuit 330 coupled in parallel with the triac. The timing circuit 330 comprises a potentiometer R332, a capacitor C334, and a calibrating resistor R336. The timing circuit operates in a similar manner to the timing circuit 230 of the MLV dimmer 200 to produce a timing voltage signal $v_T$ at an output.

The MLV dimmer further includes a rectifier bridge comprising four diodes D342A, D342B, D342C, D342D; a trigger circuit comprising a break-over circuit 360 and an offset circuit 370; a current limit circuit 380; and an optocoupler 390. The break-over circuit 360, the current limit circuit 380, and a photodiode 390A of the optocoupler 390 are connected in series across the DC-side of the rectifier bridge. The offset circuit 370 is connected such that a first portion 370A and a second portion 370B are coupled in series with the break-over circuit 360, the current limit circuit 380, and the photodiode 390A during the positive half-cycles and the negative half-cycles, respectively. The trigger circuit is coupled to the gate of the triac 320 via the optocoupler 390 and resistors R392, R394, R396.

The break-over circuit 360 includes two bipolar junction transistors Q362, Q364, two resistors R366, R368, and a zener diode Z369. The break-over circuit 360 operates in a similar fashion as the diac 260 of the MLV dimmer 200. When the voltage across the break-over circuit 360 exceeds a break-over voltage $V_{BR}$ of the zener diode Z369, the zener diode begins conducting current. The break-over voltage $V_{BR}$ of the zener diode Z369 is preferably approximately 30V. The transistor Q362 begins conducting as the voltage across the resistor R366 reaches the required base-emitter voltage of the transistor Q362. A voltage is then produced across the resistor R368, which causes the transistor Q364 to begin conducting. This essentially shorts out the zener diode Z369 such that the zener diode stops conducting, and the voltage across the break-over circuit 360 falls to approximately zero volts. A pulse of current, i.e., a control current $i_{CONTROL}$, flows from the capacitor C334 through the break-over circuit 360 and the photodiode 390A of the optocoupler 390.

A trigger voltage signal develops across the trigger circuit, i.e., the break-over circuit 360 and the offset circuit 370, as the timing voltage signal $v_T$ increases from the beginning of each line voltage half-cycle. The magnitude of the trigger voltage signal is substantially equal to the magnitude of the timing voltage signal $v_T$ plus an additional voltage $V_+$ due to the forward voltage drops of the diodes D342A, D342D, the forward voltage drop of the photodiode 390A, and the voltage drop of the current limit circuit 380. For example, the additional voltage $V_+$ may total approximately 4 volts. The trigger circuit is operable to conduct the control current $i_{CONTROL}$ through the photodiode 390A of the optocoupler 390 when the timing voltage signal $v_T$ exceeds the break-over voltage $V_{BR}$ of the zener diode Z369 of the break-over circuit 360 plus the voltage across the offset circuit 370 and the additional voltage $V_+$. The voltage across the first portion 370A of the offset circuit 370 is substantially zero volts at the beginning of each positive line voltage half-cycle and the voltage across the second portion 370B of the offset circuit 370 is substantially zero volts at the beginning of each negative line voltage half-cycle. Accordingly, the initial voltage threshold $V_1$ is approximately 34 V. The control current $i_{CONTROL}$ preferably flows through the photodiode 390A for approximately 300 μsec. Accordingly, when the photodiode 390A conducts the control current $i_{CONTROL}$, a photosensitive triac 390B of the optocoupler 390 conducts to allow current to flow into the gate of the triac 320 in the positive half-cycles, and out of the gate in the negative half-cycles.

During the positive half-cycles, the control current $i_{CONTROL}$ flows through the diode D342A, the break-over circuit 360, the photodiode 390A, the current-limit circuit 380, a capacitor C374A (and a resistor R376A), and the diode D342D. During the negative half-cycles, the control current $i_{CONTROL}$ flows through the diode D342B, a capacitor C374B (and a resistor R376B), the break-over circuit 360, the photodiode 390A, the current-limit circuit 380, and the diode D342C. Therefore, an offset voltage ΔV develops across the capacitor C374A in the positive half-cycles, and across the capacitor C374B in the negative half-cycles. Discharge resistors R376A, 376B are coupled in parallel with the capacitors C374A, C374B to allow the capacitors to discharge slowly. The capacitors C374A, C374B both preferably have capacitances of about 82 nF and the discharge resistors R376A, R376B preferably have resistances of about 68.1 kΩ.

The current-limit circuit 380 comprises a bipolar junction transistor Q382, two resistors R384, R386 and a shunt regulator zener diode Z388. After the voltage across the trigger circuit 330 drops to approximately zero volts, a voltage substantially equal to the timing voltage signal $v_T$ develops across the current-limit circuit 380. Current flows through the resistor R384, which preferably has a resistance of about 33 kΩ, and into the base of the transistor Q382, such that the transistor becomes conductive. Accordingly, the control current $i_{CONTROL}$ will flow through the photodiode 390A, the transistor Q382, and the resistor R386. The diode Z388 preferably has a shunt connection coupled to the emitter of the transistor Q382 to limit the magnitude of the control current $i_{CONTROL}$. Preferably, the shunt diode Z388 has a reference voltage of 1.25V and the resistor R386 has a resistance of about 392Ω, such that the magnitude of the control current $i_{CONTROL}$ is limited to approximately 3.2 mA.

The MLV dimmer 300 further comprises a clamp circuit 350 similar to the clamp circuit 250 of the MLV dimmer 200. The clamp circuit 350 includes two zener diodes Z352, Z354 in anti-series connection. Preferably, the zener diodes Z352, Z354 have the same break-over voltage $V_Z$, e.g., 38V, such that the timing voltage signal $v_T$ across the capacitor C344 is limited to the break-over voltage $V_Z$ in both half-cycles. Accordingly, the trigger voltage signal across the trigger circuit is limited to approximately the break-over voltage $V_Z$ minus the additional voltage $V_+$ due to the other components.

The MLV dimmer 300 exhibits a similar operation to the MLV dimmer 200. At the beginning of the positive half-cycles, the voltage ΔV across the capacitor C374A is approximately zero volts. Therefore, for the control current $i_{CONTROL}$ to flow, the timing voltage signal $v_T$ across the capacitor C334 must exceed the initial voltage threshold $V_1$, i.e., the break-over voltage $V_{BR}$ of the zener diode Z369 of the break-over circuit 360 plus the additional voltage $V_+$ due to the other components of the MLV dimmer 300. As noted above, the initial voltage threshold $V_1$ is approximately 34V.

Figure 9:
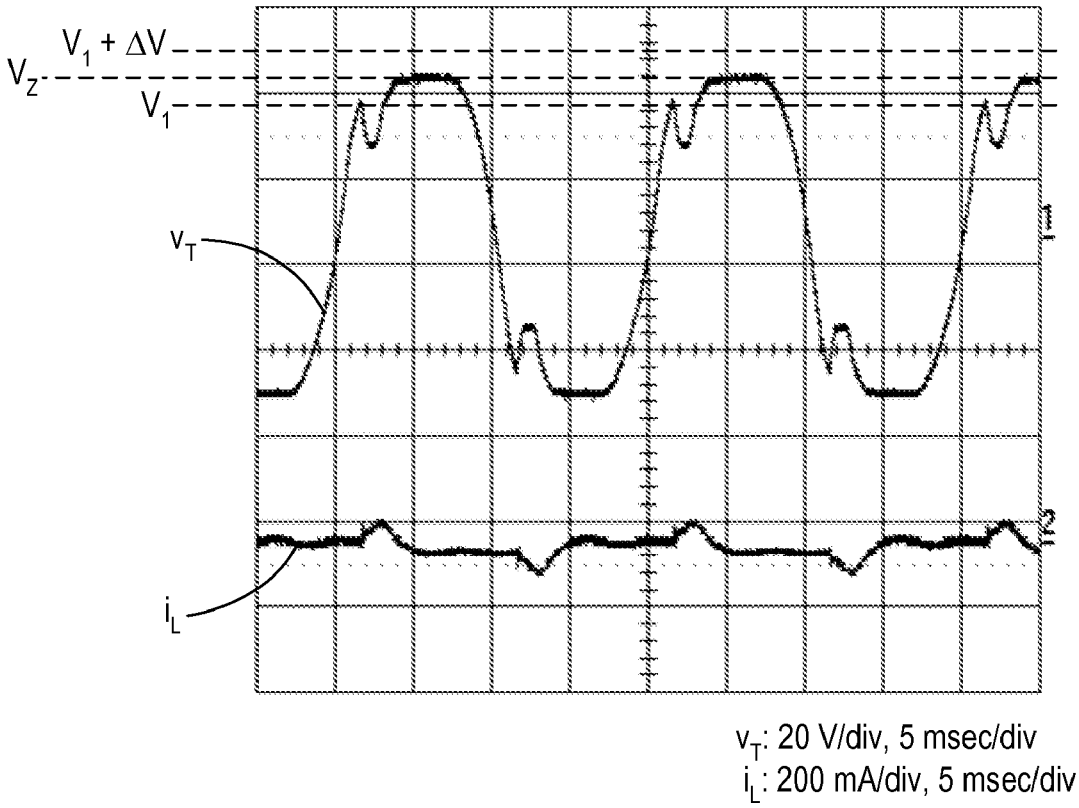
FIG. 9 is a plot of a timing voltage and a load current of the MLV dimmer of FIG. 8.

When the control current $i_{CONTROL}$ flows through the first portion 370A of the offset circuit 370, the voltage ΔV, which preferably has a magnitude of approximately 12V, develops across the capacitor C374A. Therefore, the new voltage threshold $V_{TH}$ is equal to the initial voltage threshold $V_1$ plus the voltage ΔV, i.e., approximately 42V. However, since the clamp circuit 350 limits the magnitude of the timing voltage signal $v_T$ to 38V, the timing voltage signal will not be able to exceed the voltage threshold $V_{TH}$. Thus, the triac 320 will not attempt to repeatedly fire within the same half-cycle, and the load current $i_L$ will remain substantially symmetric. A plot of the timing voltage signal $v_T$ and the load current $i_L$ of the MLV dimmer 300 is shown in FIG. 9.

Figure 10:
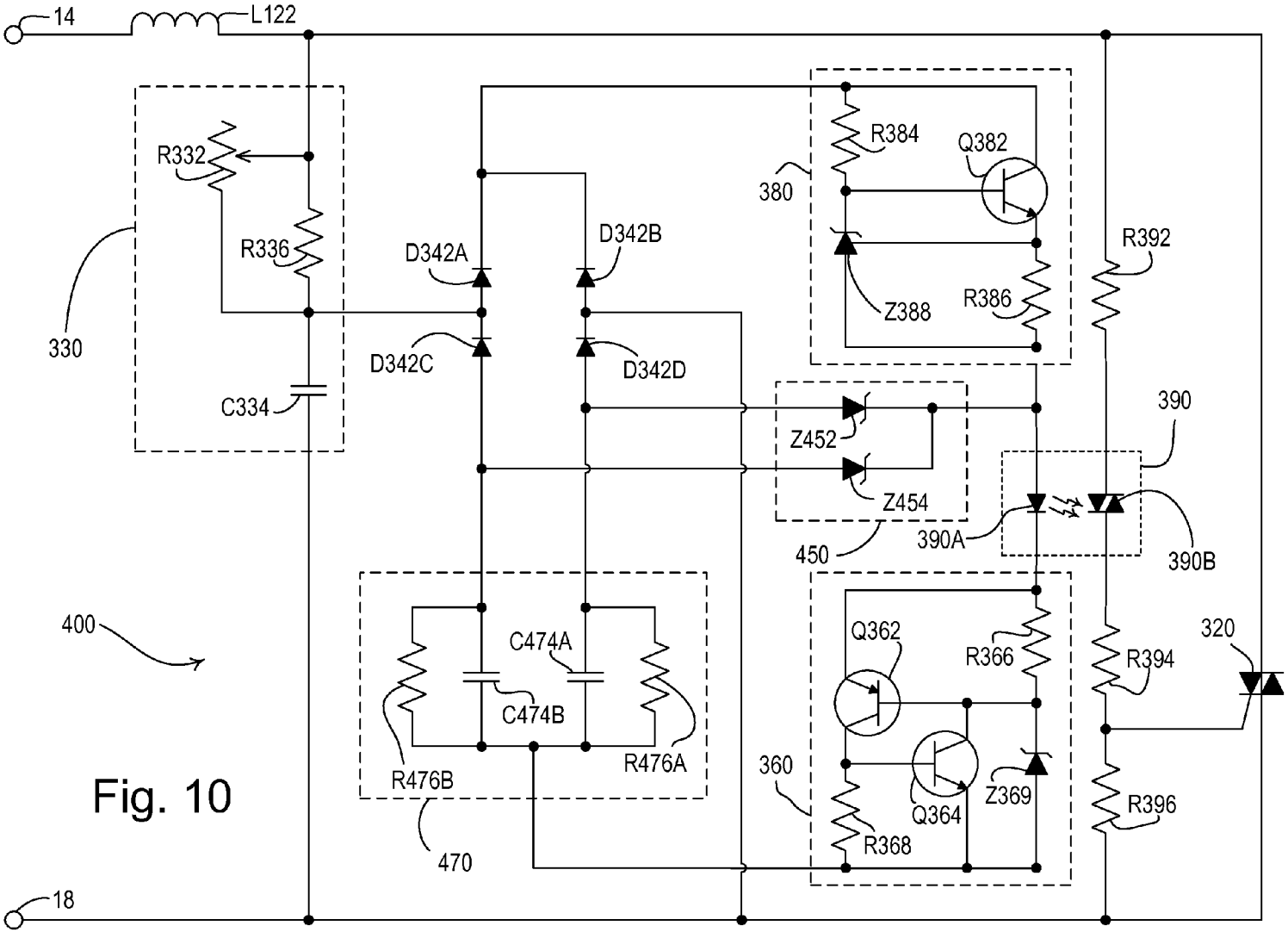
FIG. 10 is a simplified schematic diagram of an MLV dimmer according to a third embodiment of the present invention.

FIG. 10 is a simplified schematic diagram of an MLV dimmer 400 according to a third embodiment of the present invention. The dimmer 400 includes the same or very similar circuits as the MLV dimmer 300. However, the circuits of FIG. 10 are coupled together in a different manner.

The MLV dimmer 400 includes a clamp circuit 450, which is coupled across the photodiode 390A of the optocoupler 390, the break-over circuit 360, and an offset circuit 470 rather than across the AC-side of the rectifier bridge as in the MLV dimmer 200. During the positive half-cycles, a capacitor C474A in the offset circuit 470 charges to a voltage ΔV, thus increasing the voltage threshold $V_{TH}$ to the voltage ΔV plus an initial voltage threshold $V_1$. Once again, the voltage ΔV across the capacitor C474A is substantially zero volts at the beginning of the positive half-cycles, and thus, the initial voltage threshold $V_1$ is equal to the break-over voltage $V_{BR}$, e.g., approximately 30V, of the break-over circuit 360 plus the additional voltage drop $V_+$ due to the other components. A first zener diode Z452 of the clamp circuit 450 limits the magnitude of the trigger voltage (i.e., the voltage across the break-over circuit 360 and the capacitor C474A of the offset circuit 470) plus the forward voltage drop of the photodiode 390A to the break-over voltage $V_Z$ of the zener diode Z452, e.g., approximately 36V. Similarly, during the negative half-cycles, a capacitor C474B charges to a voltage ΔV and a zener diode Z454 limits the magnitude of the trigger voltage (i.e., the voltage across the break-over circuit 360 and the capacitor C474B of the offset circuit 470) plus the forward voltage drop of the photodiode 390B to the same break-over voltage $V_Z$.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A trigger circuit operable to control a semiconductor switch in a load control device, the trigger circuit comprising:

a break-over circuit characterized by a break-over voltage and operable to conduct a control current when a voltage across the break-over circuit exceeds the break-over voltage, the semiconductor switch operable to change between the non-conductive and conductive states in response to the control current; and an offset circuit coupled in series with the break-over circuit and comprising an offset capacitor operable to conduct the control current, whereby an offset voltage develops across the offset capacitor;

wherein the trigger circuit is characterized by an initial voltage threshold before the break-over circuit and the offset circuit conduct the control current, the initial voltage threshold having a magnitude approximately equal to the magnitude of the break-over voltage, the trigger circuit further characterized by a second voltage threshold after the break-over circuit and the offset circuit conduct the control current, the second voltage threshold having a maximum magnitude approximately equal to the break-over voltage of the break-over circuit plus the offset voltage.

2. The trigger circuit of claim 1, wherein the offset circuit further comprises a discharge resistor coupled in parallel electrical connection with the offset capacitor.

3. The trigger circuit of claim 1, wherein the semiconductor switch comprises a triac having a gate.

4. The trigger circuit of claim 3, wherein the trigger circuit is operable to be coupled in series electrical connection with the gate of the triac, such that the control current is operable to flow through the gate of the triac.

5. The trigger circuit of claim 1, wherein the break-over circuit comprises a zener diode and a semiconductor switch, such that the break-over voltage of the break-over circuit is approximately equal to a break-over voltage of the zener diode, and a voltage across the break-over circuit is reduced to approximately zero volts after the break-over circuit conducts the control current.

6. The trigger circuit of claim 1, wherein the break-over circuit comprises a diac, such that the break-over voltage of the break-over circuit is approximately equal to a break-over voltage of the diac.

7. The trigger circuit of claim 1, wherein the load control device comprises a clamp circuit operable to limit the magnitude of the trigger voltage across the trigger circuit to approximately a clamp magnitude greater than the initial voltage threshold and less than the second voltage threshold, such that the trigger voltage is prevented from exceeding the second voltage threshold.

8. A drive circuit for controlling a semiconductor switch in a load control device, the drive circuit comprising:

a break-over circuit characterized by a break-over voltage and operable to conduct a control current when a voltage across the break-over circuit exceeds the break-over voltage, the semiconductor switch operable to change between the non-conductive and conductive states in response to the control current; and an offset circuit coupled in series with the break-over circuit and comprising an offset capacitor operable to conduct the control current, whereby an offset voltage develops across the offset capacitor; and a clamp circuit operable to limit the magnitude of the voltage across the series combination of the break-over circuit and the offset circuit to approximately a clamp magnitude that is greater than the initial voltage threshold and less than the second voltage threshold;

wherein the break-over circuit is operable to conduct the control current when a voltage across the series combination of the break-over circuit and the offset circuit exceeds a initial voltage threshold and to conduct the control current again only if the voltage across the series combination of the break-over circuit and the offset circuit subsequently exceeds a second voltage threshold, the initial voltage threshold having a magnitude approximately equal to the magnitude of the break-over voltage of the break-over circuit, the second voltage threshold having a magnitude approximately equal to the break-over voltage of the break-over circuit plus the offset voltage, the clamp circuit preventing the voltage across the series combination of the break-over circuit and the offset circuit from exceeding the second voltage threshold.

9. The drive circuit of claim 8, wherein the offset circuit further comprises a discharge resistor coupled in parallel electrical connection with the offset capacitor.

10. The drive circuit of claim 8, wherein the semiconductor switch comprises a triac having a gate.

11. The drive circuit of claim 10, wherein the break-over circuit is adapted to be coupled in series electrical connection with the gate of the triac, such that the control current is operable to flow through the gate of the triac.

12. The drive circuit of claim 8, wherein the break-over circuit comprises a zener diode and a semiconductor switch, such that the break-over voltage of the break-over circuit is approximately equal to a break-over voltage of the zener diode, and a voltage across the break-over circuit is reduced to approximately zero volts after the break-over circuit conducts the control current.

13. The drive circuit of claim 8, wherein the break-over circuit comprises a diac, such that the break-over voltage of the break-over circuit is approximately equal to a break-over voltage of the diac.

* * * * *